US006158126A

United States Patent [19]

Rose, Jr. et al.

[11] Patent Number: 6,158,126

[45] Date of Patent: Dec. 12, 2000

[54] PIEZOELECTRICALLY ACTUATED SHAVER

[75] Inventors: Norvell S. Rose, Jr., Virginia Beach, Va.; Brennan C. Swain, Manhattan Beach, Calif.; Stephen E. Clark, Norfolk, Va.

[73] Assignee: Face International Corp., Norfolk, Va.

[21] Appl. No.: 09/250,855

[22] Filed: Feb. 17, 1999

Related U.S. Application Data

[60] Provisional application No. 60/075,084, Feb. 18, 1998.

[51] Int. Cl.[7] ..... B26B 19/02; B26B 19/38

[52] U.S. Cl. ..... 30/43.92; 30/DIG. 1

[58] Field of Search ..... 30/43.92, 45, 43.9, 30/DIG. 2, DIG. 1, 346.51

[56] References Cited

U.S. PATENT DOCUMENTS 3,376,636 4/1968 Schuessler ..... 30/43.92 X 3,631,595 1/1972 Scott ..... 30/45

5,794,342 8/1998 Davey ..... 30/45

*Primary Examiner*—Douglas D. Watts

*Attorney, Agent, or Firm*—Stephen E. Clark; David J. Bolduc

[57] ABSTRACT

A small, lightweight, efficient, quiet electric shaver is provided in which one or more piezoelectric drivers are mechanically coupled to a cutting blade. The cutting action of the blade is generated by the piezoelectric drivers which, when electrically energized, oscillate at a predetermined frequency. The piezoelectric driver is electrically energized by a regenerative drive circuit. Hair shafts, which protrude from the surface to be shaved through a perforated foil member, are sheared at their base by the oscillating action of the blade.

10 Claims, 5 Drawing Sheets

PIEZOELECTRICALLY ACTUATED SHAVER

This appln claims the benefit of U.S. Provisional No. 60/075,084 filed Feb. 18,1998.

BACKGROUND OF THE INVENTION

1. Field of Invention

The present invention relates to electric shavers. More particularly the present invention is directed to an electric shaver which is actuated by a piezoelectric element.

2. Description of the Prior Art

Recently, both men and women have been increasingly drawn to the advantages provided by electric dry shavers. In general, the consuming public has found that the use of razors or other systems is extremely inconvenient for removing or shaving short hair or stubble, as commonly found in men's' beards and women's' legs. In addition, with the ever increasing time constraints and commitments individuals typically encounter, a fast and effective shaving system is most desirable.

Conventional disposable, straight or similar non-electric razors are very popular among users because they provide a very effective or "close" shave. However, they are often uncomfortable and/or irritating to the user's skin. Disposable razors also are prone to cutting or "nicking" the surface to be shaved due to intimate contact between the razor blade and the user's skin. A lubricating medium and/or warm water is usually required for use of conventional disposable razors to help eliminate undesirable results. Without water or a lubricating medium, or typically both, the shaving process can be very uncomfortable to the user. The discomfort, as well as the time consumed in using shaving cream, soaps and gels in order to provide a medium for which a razor can be used, requires more time and inconvenience than most individuals are willing or capable of allowing. Furthermore, conventional disposable razor blades become dull after only a few uses and must be replaced. Also, maintenance of a supply of all of these products is costly.

Consequently, electric dry shavers have become increasingly popular, as well as battery operated electric dry shavers which can withstand exposure to moisture, thereby enabling individuals simultaneously to shower and shave.

As the popularity of electric dry shavers increased, various product designs and alternate constructions proliferated, in an attempt to improve and enhance the comfort and cutting efficiency of such shavers. However, in spite of these product changes, difficulties have persisted in providing optimum results with optimum comfort.

Prior art electric shavers typically use bulky, intricate solenoid motors which can easily break down, are difficult to repair, and are noisy. These motors also drain the battery life relatively quickly due to the high amount of moving parts in the motor, resulting in oft needed recharging of battery powered electric shavers.

One particular configuration has been found to be extremely efficacious in achieving high quality shaving results, as well as being extremely comfortable to use. This configuration comprises the various models of electric dry shavers incorporating a movable cutting blade which cooperates with a thin, flexible mesh screen, or apertured foil.

In operation, the cutting blades are rapidly and continuously moved against or near one side of the mesh screen or apertured foil, causing the cutting blades to repeatedly cross the plurality of apertures and provide a virtually continuous cutting action at each aperture. Then, by sliding or guiding the other side of the mesh screen or apertured foil over the skin surface to be shaved, the individual hair shafts enter the holes formed in the screen or foil and are cut by the movement of the cutting blades. This prior shaver configuration typically employs the use of solenoid motors, which, as mentioned above, tend to drain battery life relatively quickly.

Accordingly, it would be desirable to provide an electric razor which is lightweight and of relatively simple construction, and which operates quietly and efficiently.

SUMMARY OF THE INVENTION

The present invention provides a small, lightweight, efficient, quiet electric shaver. In a preferred embodiment of the invention, one or more piezoelectric drivers are mechanically coupled to a cutting blade which is advantageously oscillated. The oscillating action of the razor blade is generated by the piezoelectric drivers which, when energized oscillate at a predetermined frequency. The oscillating action of the blade advantageously shears the hair shafts, which protrude from the surface to be shaved through a perforated foil member, at their base.

Accordingly, it is a primary object of the present invention to provide a piezoelectrically actuated shaver that is efficient, simple in design, easy to use, quiet and which overcomes the aforementioned disadvantages of the prior art.

It is another object of the present invention to provide a device of the character described which is not prone to cutting or "nicking" the surface to be shaved.

It is another object of the present invention to provide a device of the character described in which the blade is driven by an oscillating piezoelectric driver.

It is another object of the present invention to provide a device of the character described which severs the hair shafts at their base while at the same time does not harm the surface to be shaved.

It is another object of the present invention to provide a device of the character described which is battery powered.

It is another object of the present invention to provide a modification of the present invention which is powered by a/c house current.

It is another object of the present invention to provide a device of the character described which is at the same time compact, light in weight, and of an extremely simple and uncluttered design.

Further objects and advantages of this invention will become apparent from a consideration of the drawings and ensuing description thereof.

DESCRIPTION OF THE PREFERRED EMBODIMENT

Figure 1:
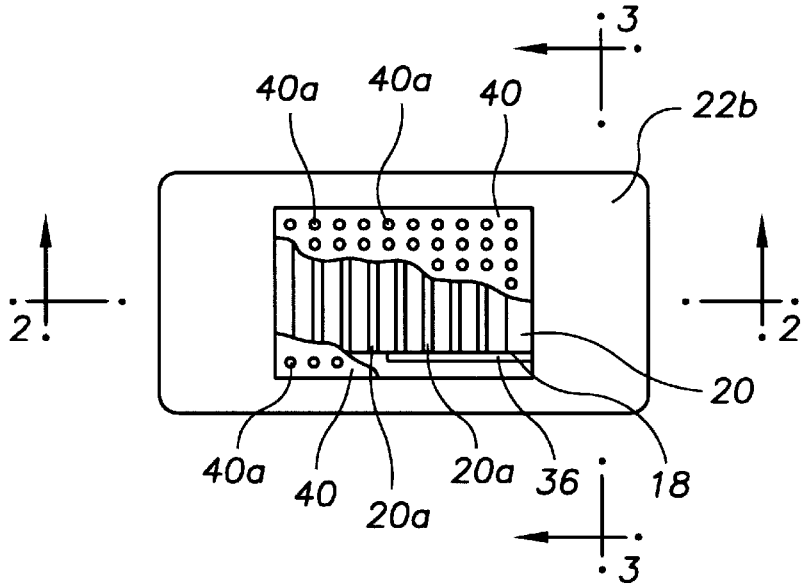
FIG. 1 is plan view of a piezoelectrically actuated shaver in accordance with the present invention, with the foil cut away to show the cutting member underneath.

With initial reference directed toward FIGS. 1–3 of the appended drawings a piezoelectrically actuated shaver embodying the principles and concepts of the present invention and generally designated by the reference numeral 1 will be described.

The shaver 1 generally comprises a housing 22 which surrounds an interior cavity 34. In the preferred embodiment of the invention two mounting members 24 are disposed within the interior cavity 34. The mounting members 24 each comprise a first portion 24*a* which extends along one side 22*a* of the housing 22 and a second portion 24*b* which extends along the top 22*b* of the housing 22 as shown in FIGS. 2 and 3. The mounting members 24 are rigidly attached to the inside surface of the housing 22 by conventional means.

Figure 2:
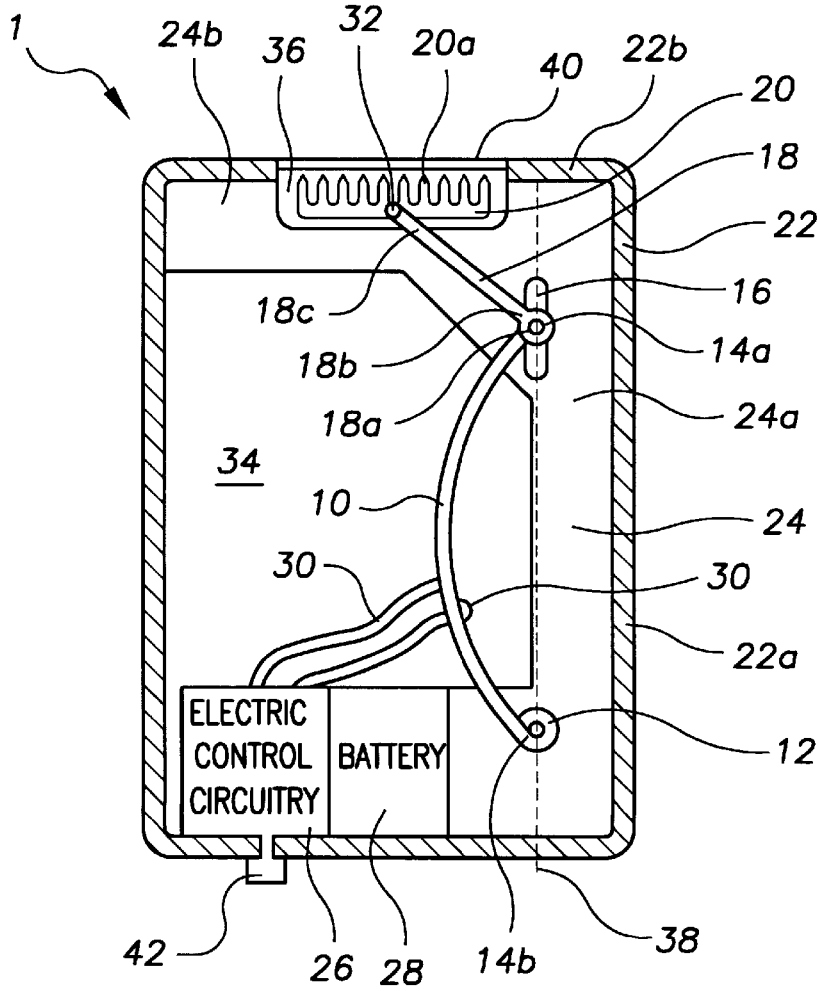
FIG. 2 is a cross-sectional front elevation of the shaver taken along the line 2—2 of FIG. 1.
Figure 3:
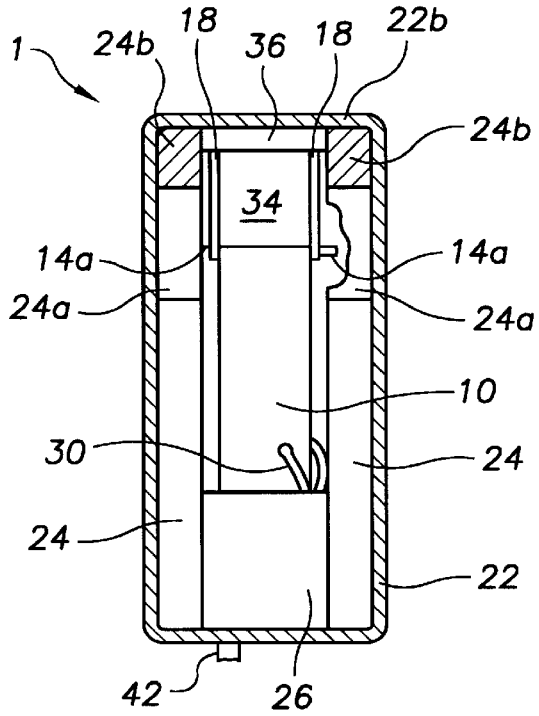
FIG. 3 is a cross-sectional side elevation of the shaver taken along the line 3—3 of FIG. 1.

A groove 16 and a hole (not shown), adapted to receive pins 14*a* and 14*b*, respectively, are machined in the first portion 24*a* of each mounting member 24 along an axis 38, as shown in FIG. 2. The opposite ends of the first and second pins 14*a* and 14*b* are inserted into the grooves 16 and the holes (not shown), such that the first and second pins 14*a* and 14*b* extend between the two mounting members 24. A piezoelectric driver 10 is positioned in the interior cavity between the two mounting members 24. In the preferred embodiment of the invention the piezoelectric driver 10 is an elongated band having a nominally curved shape. In the preferred embodiment of the present invention the receiving loops 12 are formed by shaping the end of the piezoelectric driver 10 into a circular configuration. However, it will be appreciated by those skilled in the art that other means for advantageously attaching the first and second pins 14*a* and 14*b* to the ends of the piezoelectric driver 10 may alternatively be used in place of the receiving loops 12.

Opposite end portions of the first and second pins 14*a* and 14*b* extend from the receiving loops 12. The opposite end portions of the first pin 14*a* each extend through holes 18*a* located at a first end 18*b* of two linking members 18. The first end 18*b* of each linking member 18 is pivotably secured to the end portion of the first pin 14*a* between the receiving loop 12 and the mounting member 24 as shown in FIG. 3.

The linking members 18 are pivotably secured to a cutting blade 20 at their second ends 18*c* by a third pin 32. In the preferred embodiment of the invention the cutting blade 20 comprises a plurality of cutting edges 20*a*, however, it is within the scope of the present invention to employ a cutting blade 20 having only one cutting edge 20*a* or to use alternative cutting means. The cutting blade 20 is advantageously disposed within a blade chamber 36. The blade chamber 36 is located in the top portion 22*b* of the housing 22, and extends downwardly into the second portion 24*b* of the mounting members 24 as shown in FIG. 2.

Now referring to FIG. 1: Attached at its perimeter to the top portion 22*b* of the housing 22 is a perforated foil 40 which covers the blade chamber 36. In the preferred embodiment of the invention the foil 40 has a plurality of apertures 40*a* that extend through the foil 40, from the blade chamber 36 to the exterior of the device. The apertures 40*a* may be circular, square, rectangular or any other advantageous shape. The cutting edges 20*a* extend within a very small, predetermined distance of the bottom surface of the foil 40, such that when the exposed surface of the foil 40 is placed into intimate contact with the surface to be shaved (not shown) hair shafts extend through the apertures 40*a* in the foil 40, and are sheared by the cutting blade 20.

In the preferred embodiment of the invention the piezoelectric driver 10 is a flextensional piezoelectric transducer. Various constructions of flextensional piezoelectric transducers may be used but the piezoelectric driver 10 preferably comprises a Thin Layer Unimorph Driver and Sensor actuator (as disclosed in U.S. Pat. No. 5,632,841) constructed in accordance with the following description.

Figure 4:
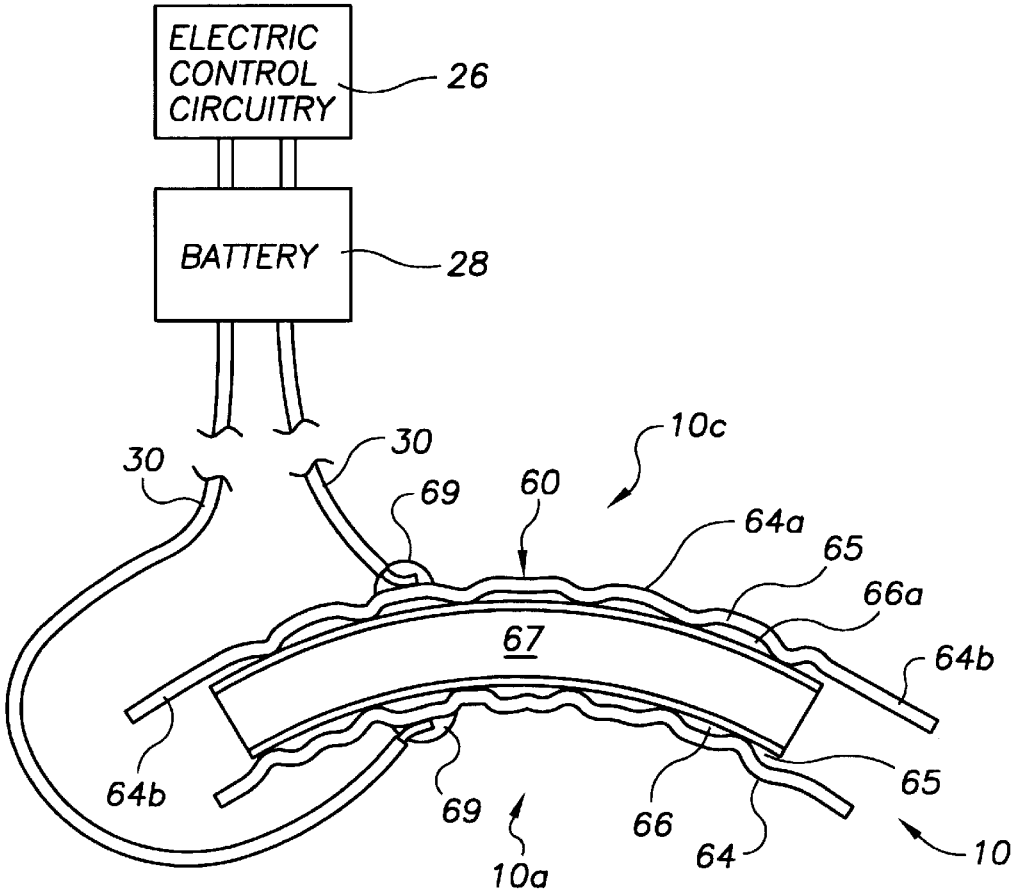
FIG. 4 is a side elevation showing details of construction of a piezoelectric driver used in the preferred embodiment of the present invention.

The details of construction of a piezoelectric driver 10 are illustrated in FIG. 4. Each piezoelectric driver 10 is preferably constructed with a PZT piezoelectric ceramic layer 67 which is electroplated 65 and 65*a* on its two opposing faces. A steel, stainless steel, beryllium alloy or other metal first pre-stress layer 64 is adhered to the electroplated 65 surface on one side of the ceramic layer 67 by a first adhesive layer 66. The first adhesive layer 66 is preferably LaRC™-SI material, as developed by NASA-Langley Research Center (as disclosed in U.S. Pat. No. 5,639,850) and commercially marketed by IMITEC, Inc. of Schenectady, New York. A second adhesive layer 66*a*, also preferably comprising LaRC-SI material, is adhered to the opposite side of the ceramic layer 67. During manufacture of the piezoelectric driver 10 the ceramic layer 67, the adhesive layers 66 and 66*a* and the first pre-stress layer 64 are simultaneously heated to a temperature above the melting point of the adhesive material, and then subsequently allowed to cool, thereby re-solidifying and setting the adhesive layers 66 and 66*a*. During the cooling process the ceramic layer 67 becomes compressively stressed, due to the higher coefficient of thermal contraction of the material of the pre-stress layer 64 than for the material of the ceramic layer 67. Also, due to the greater thermal contraction of the laminate materials (e.g. the first pre-stress layer 64 and the first adhesive layer 66) on one side of the ceramic layer 67 relative to the thermal contraction of the laminate material(s) (e.g. the second adhesive layer 66*a*) on the other side of the ceramic layer 67, the ceramic layer deforms in an arcuate shape having a normally concave face 10*a* and a normally convex face 10*c*, as illustrated in FIG. 4. One or more additional pre-stressing layer(s) 64*a* may be similarly adhered to either or both sides of the ceramic layer 67 in order, for example, to increase the stress in the ceramic layer 67 or to strengthen the actuator 10.

Electrical energy may be introduced to the piezoelectric driver 10 from a battery 28 by a pair of electrical wires 30 attached to opposite sides of the piezoelectric driver 10 in communication with the electroplated 65 and 65*a* faces of the ceramic layer 67. As discussed above, the pre-stress layers 64 and 64*a* are preferably adhered to the ceramic layer 67 by LaRC-SI material. The wires 30 may be connected (for example by glue or solder 69) directly to the electroplated 65 and 65*a* faces of the ceramic layer 67, or they may alternatively be connected to the pre-stress layers 64 and 64*a*. LaRC-SI is a dielectric. When the wires 30 are connected to the pre-stress layers 64 and 64*a*, it is desirable to roughen a face of each pre-stress layer 64 and 64*a*, so that the pre-stress layers 64 and 64*a* intermittently penetrate the respective adhesive layers 66 and 66*a*, and make electrical contact with the respective electroplated 65 and 65*a* faces of the ceramic layer 67.

It will be appreciated by those skilled in the art that by using a piezoelectric driver 10 comprising a pre-stressed piezoelectric element the strength, durability, and piezoelectric deformation (i.e. output) of the piezoelectric driver are each greater than would normally be available from a comparable piezoelectric device which is not pre-stressed. Accordingly, in the preferred embodiment of the invention it is desirable to employ a piezoelectric driver 10 comprising a pre-stressed piezoelectric element; however, a non-pre-stressed piezoelectric element may alternatively be used in modified embodiments of the present invention.

As mentioned above, the wires 30 are each connected at one end to the piezoelectric driver 10 and at the opposite end to the battery 28. The battery 28 is in electrical communication with the electric control circuitry 26. Located on the outside of the housing 22, and in communication with the battery 28 and the electric control circuitry 26, is a switch 42 (as shown in FIG. 1) having an "off" and an "on" position. The operator may turn the supply of electrical energy to the piezoelectric driver 10 on or off by moving the switch 42 to the "on" or "off" position respectively.

Electricity is provided to the piezoelectric driver 10 by the battery 28 via wires 30 attached to corresponding electrodes 65. In the preferred embodiment of the invention, the piezoelectric driver 10, and therefore the cutting blade 20 is oscillated at a frequency which is advantageous in severing the hairs shafts (not shown).

Figure 5:
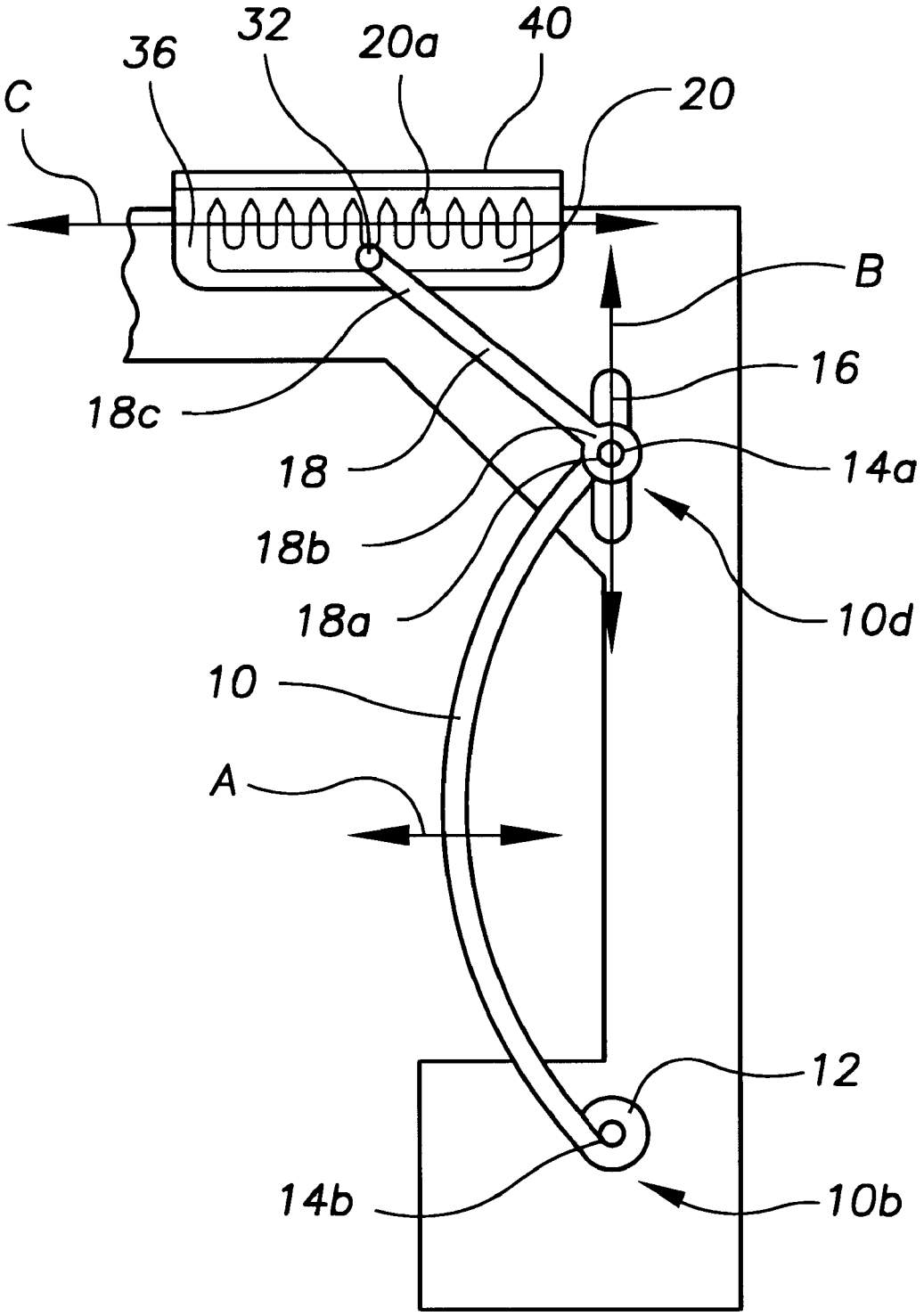
FIG. 5 is a partial cross-sectional view similar to FIG. 2.
Figure 6:
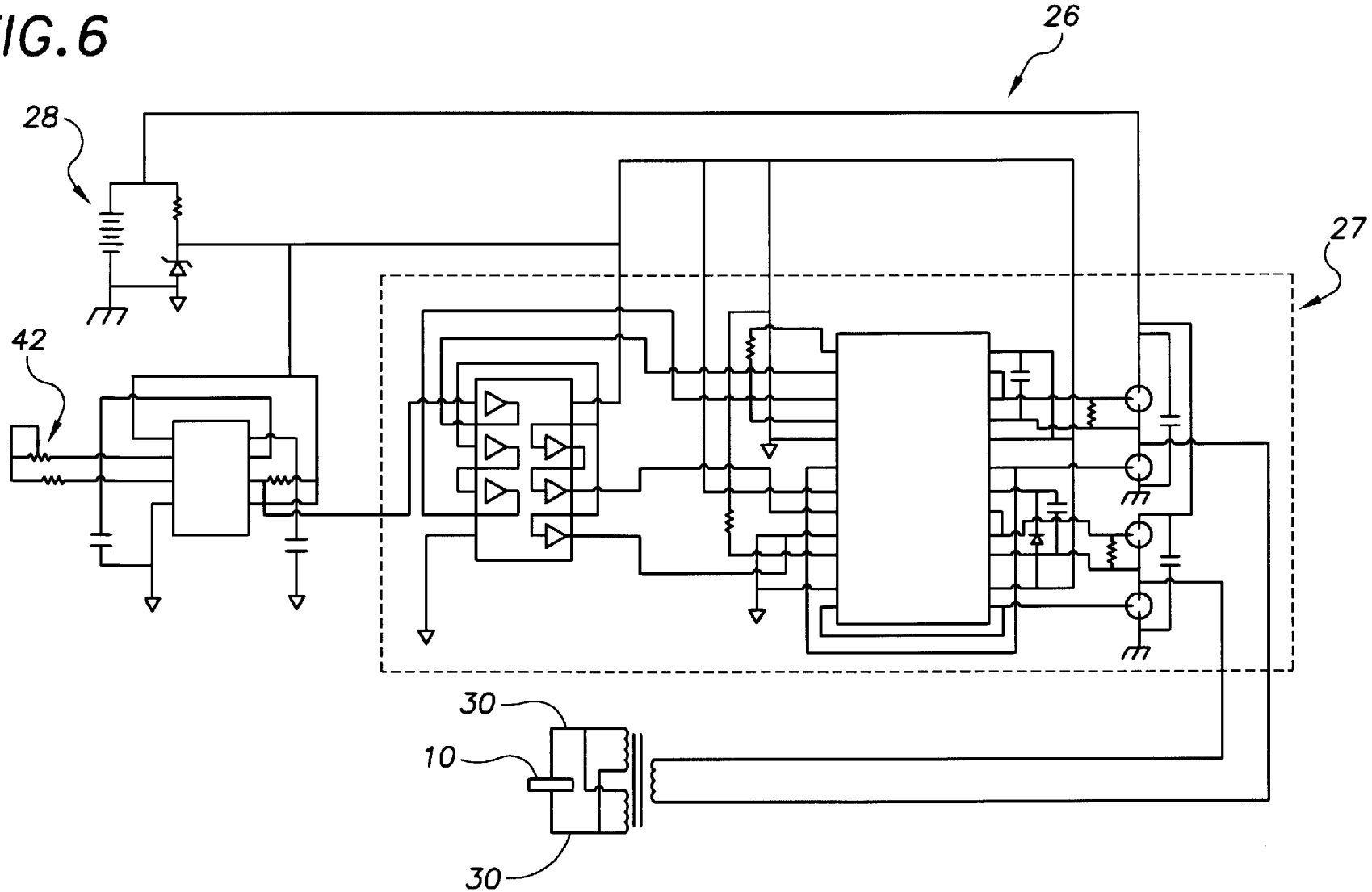
FIG. 6 is a schematic diagram of the electrical control circuitry of the preferred embodiment of the present invention.

Now referring to FIG. 5: In the preferred embodiment of the present invention, the piezoelectric driver 10 is electrically energized by an alternating current provided by the battery 28 in combination with a "d/c to a/c converter" 27 (described more fully herein below) which is included in the electric control circuitry 26 as shown in FIG. 6. When the piezoelectric driver 10 is electrically energized the alternating current causes the midsection of the piezoelectric driver 10 to deform "up and down" in an axial direction as indicated by arrow A. The second end 10*b* of the piezoelectric driver 10 is held in a substantially fixed position by the second pin 14*b*. As a result of the axial deformation of the midsection of the piezoelectric driver 10 (indicated by arrow A) and the fixed nature of the second end 10*b* of the piezoelectric driver 10, the first end 10*d* of the piezoelectric driver 10 is allowed to move linearly as indicated by arrow B in FIG. 5. This movement is a result of the first pin's 14*a* substantially linear freedom of movement parallel to is the longitudinal axes of the grooves 16.

The first end 18*b* of linking member 18, being connected to the first pin 14*a*, also linearly travels with the first pin, as indicated by arrow B. Motion of the first end 18*b* of the linking member is translated to the second end 18*c* of the linking member 18, resulting in linear motion of the cutting blade 20 as indicated by arrow C in FIG. 5.

In operation, the shaver 1 is energized by moving the switch 42 to the "on" position. The rear end portion of the housing 22 is grasped by the operator, and the foil 40 is placed against the surface to be shaved. The switch 42 is electrically connected to the battery 28, and the electric control circuitry 26. The "d/c to a/c converter" 27, which is a part of the electric control circuitry 26, converts the direct current from the battery into an alternating current, which energizes the piezoelectric driver 10, causing the oscillation of the cutting blade 20 at a frequency corresponding to the frequency of the alternating current. When the foil 40 is placed against the surface to be shaved, hair shafts protrude through the apertures 40*a* and are sheared off by the vibration of the cutting blade 20. This advantageous construction prevents the surface to be shaved from being cut or nicked in the normal course of use.

Referring now to FIG. 6: The control circuitry 26 preferably comprises a regenerative drive circuit and a "d/c to a/c converter". As will be explained more fully below, the regenerative drive circuit optimizes the electrical-to-mechanical energy conversion efficiency of the piezoelectric driver 10 by supplementing electric power supplied to the device from the battery 28 with piezoelectrically generated electricity produced by the mechanical deformation of the piezoelectric driver 10.

The preferred embodiment of the invention comprises a regenerative drive circuit in which the amount of electrical energy required to generate the desired mechanical vibrations are minimized, piezoelectrically generated electrically energy is recovered, the piezoelectric driver 10 is prevented from overheating, and the electrical-to-mechanical energy conversion efficiency of the piezoelectric driver 10 is maximized. An explanation of this preferred drive circuit follows: Active loads are loads which are capable of returning energy into the output of the source driving the load. A piezoelectric transducer/driver is an example of an active load. A piezoelectric transducer produces a potential difference (voltage) across itself when forced to expand or contract. Piezoelectric transducers have elements of resistance, capacitance, and inductance. Since both capacitors and inductors are energy storage devices, some of the energy driving the transducer is stored within the piezoelectric transducer.

Voltage is stored within the capacitive element of the piezoelectric transducer. This stored source voltage adds to the potential difference created by the expanded (or contracted) transducer, thus causing an elevated voltage which significantly increases with time and renders such a system unstable. This elevated voltage may be dissipated either by returning energy to the source or internally dissipating electrical energy across the resistive element of the transducer. Prior art includes a circuit which dissipates the elevated voltage when it exceeds a threshold by dropping the voltage across a Zener diode, making an inefficient use of the stored energy.

The elevated voltage creates problems when active loads are driven for even short periods of time (i.e. a few minutes). For example, as piezoelectric transducers are driven, the stored voltage increases with each successive expansion or contraction of the piezoelectric transducer. Eventually, the voltage either exceeds the source's capability to absorb the excess voltage, causing source failure, or the dielectric constant of the piezoelectric transducer is exceeded, resulting in the "arcing" and eventual "shorting" of the transducer. Excessive heat is also generated within the transducer as a result of this elevated voltage being dissipated across the resistive element within the piezoelectric transducer.

The present invention comprises a regenerative drive circuit for a piezoelectric driver 10. The piezoelectrically generated electrical energy is captured, stored, and returned to the source voltage in a manner such that very little energy is necessary to expand (or contract) the piezoelectric driver 10). This circuit reduces the internal heat of the piezoelectric transducer (e.g. piezoelectric driver 10) by removing both the generated and stored potential differences of the piezoelectric transducer. Cooling the transducer in this manner yields a higher electrical-to-mechanical conversion efficiency of the piezoelectric driver 10 itself, thus lowering the amount power necessary to drive the load. The circuit also increases the life of the battery 28 by regulating energy returned to it.

FIG. 6 illustrates an electric schematic of the electric control circuitry, including the regenerative drive circuit. A battery B1 supplies 28 VDC to the driver circuit. A resistor R8 drops the source voltage to 12 VDC so that it can be used by integrated circuit chips U1, U2, and U3. Chip U1 is a CMOS timer chip which converts the direct current source voltage from battery B1 into a square wave. The frequency of the square wave produced by U1 may be varied by changing the value of the potentiometer R3. The square wave output from U1 is connected to the inputs of several Schmitt triggered inverters located in chip U2. These inverters have faster switching capabilities than regular inverters, thus peak rise times are faster resulting in a more square wave output. Schmitt inverters also reduce noise chattering at high frequencies.

Chip U2 produces two output signals. One signal is the inverse of the other. These two signal outputs, from pins 2, 6, 8, and 10 on chip U2, are connected to driver input pins 2, 3, 9, and 8 on the driver chip U3, respectively. The U3 chip controls the switching of four Metal Oxide Semiconductor Field Effect Transistors (MOSFETs), Q1–Q4. Driver input pins 2 and 9 are provided with inverted signals, while driver input pins 3 and 8 are provided with uninverted signals, thus creating a switching sequence which turns Q1 and Q2 "off" while Q3 and Q4 are "on", respectively. The switching sequence allows current from the battery to be alternated within the transformer. The alternating current is then "stepped up" to the "operating voltage" of the load using a transformer, T1. In this embodiment, T1 is a 4.1:1 ratio transformer, which steps the 24 volts provided by the battery B1 to 200 volts peak to peak. The "operating voltage" is simply the amount of voltage necessary to deform the load (piezoelectric driver 10).

The MOSFETs, Q1–Q4, help provide the regenerative capability of the circuit. Their switching sequence allows the load the ability to dissipate energy by reversing the process discussed in the previous paragraph. Voltage stored within the load is "stepped down" and returned to the battery B1, resulting in an efficient use of energy stored and produced by the load (e.g. piezoelectric driver 10).

Figure 7:
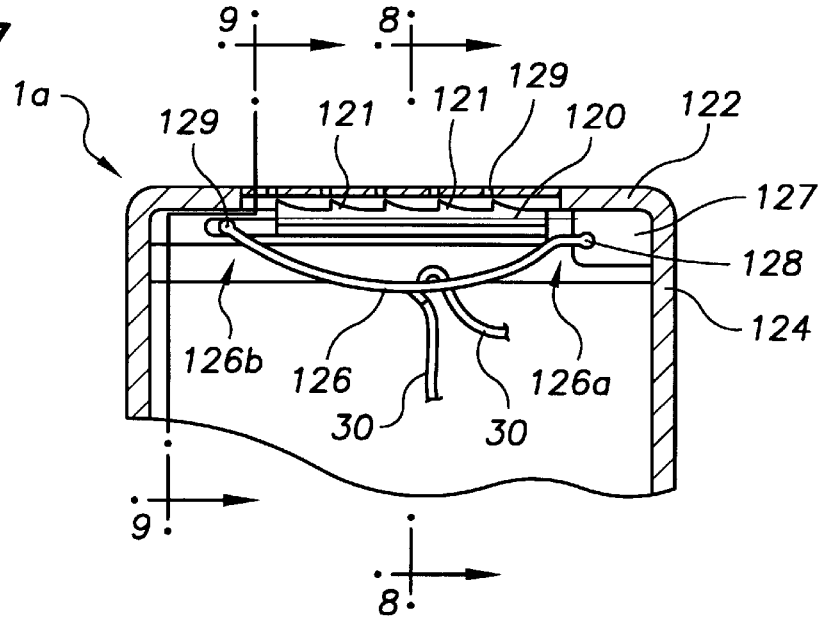
FIG. 7 is a partial cross-sectional view showing a modified construction of the present invention.
Figure 8:
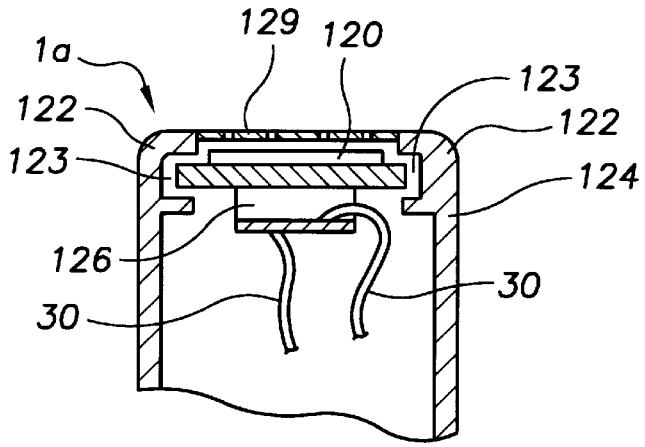
FIG. 8 is a cross-sectional view taken along the line 8—8 of FIG. 7.
Figure 9:
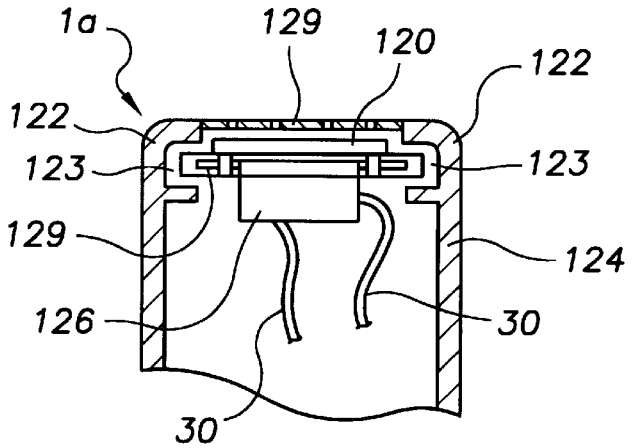
FIG. 9 is a cross-sectional view taken along the line 9—9 of FIG. 7.

FIGS. 7–9 illustrate a modified piezoelectric shaver 1*a*. In this modified piezoelectric shaver 1*a* a cutting blade 120 having a plurality of cutting edges 121 in close proximity to a perforated foil 129 is provided with a pair of longitudinally parallel spaced apart shoulders 122. The cutting blade 120 is slidably supported with corresponding shoulder guides 123 that are in the form of longitudinally oriented recesses in the interior of the shaver housing 124. A band-shaped piezoelectric driver 126 is pivotably attached at one end 126*a* to a fixed mounting support 127 by a hinge pin 128. The second end 126*b* of the piezoelectric driver 126 is pivotably attached to one end 120*a* of the cutting blade by another hinge pin 129. In operation, alternating electrical energy is supplied to the piezoelectric driver 126 via wires 30 in the same manner described above with respect to the preferred embodiment of the invention. When alternating electrical energy is applied to the piezoelectric driver 126, the driver 126 piezoelectrically deforms such that the second end 126*b* of the driver linearly oscillates in a direction parallel to the longitudinal axes of the shoulders 122. The linear oscillation of the second end 126 of the piezoelectric driver causes the cutting edges 121 of the cutting blade 120 to move back and forth in close proximity to the perforated foil 129.

It will be understood from the above description that piezoelectric driver 10 used in the present invention is very lightweight and comprises very few parts. Therefore, maintenance costs for the device are kept at a minimum. These characteristics compare favorably to the bulk and intricacy of the motors, solenoids, etc., that are used in prior electric shavers.

It should be understood that it is within the scope of the present invention to advantageously oscillate tools other than the blade(s) of shavers 1 using a piezoelectric driver 10. Such tools include, but are not limited to, items such as scalpels, saw blades, knives, razor blades, wood cutters, axes, machine tools and lancets.

While the above description contains many specificities, these should not be construed as limitations on the scope of the invention, but rather as an exemplification of one preferred embodiment thereof. Many other variations are possible, for example:

A power cord that may be provided for connection to a typical a/c wall outlet, which provides a frequency of 60 Hertz. The cord may be connected to the shaver circuit, thus obviating the need for a battery and eliminating recharge time;

The piezoelectric driver(s) may be normally curved when non-energized, or they may alternatively be normally flat when non-energized;

Various other flextensional piezoelectric transducers may be used, including, for example, "moonies", "rainbows", and other unimorph, bimorph, multimorph or monomorph devices, as disclosed in U.S. Pat. No. 5,471,721;

Magneto-strictive, ferroelectric and other non-piezoelectric materials may be used to produce the vibrations;

The number of piezoelectric drivers may vary;

The number of cutting blades may vary; and

The shaver may have a frequency adjustment mechanism.

Accordingly, the scope of the invention should be determined not by the embodiment illustrated, but by the appended claims and their legal equivalents.

What is claimed is:

1. A safety shaver comprising:

a housing with an interior cavity and a blade chamber; said interior cavity having an interior surface;

a first mounting member disposed within said cavity and rigidly attached to said interior surface;

said first mounting member having a first groove machined therethrough;

a driver member having first and second ends disposed within said cavity;

said first end of said driver member being pivotably attached to said first mounting member;

said second end of said driver member being slidably disposed within said groove;

a cutting blade slidably disposed within said blade chamber;

a linking member with first and second end portions;

said first end portion being pivotably attached to said second end of said driver member;

said second end portion being pivotably attached to said cutting blade; and electrical energizing means in electrical communication with said electroactive driver member.

2. The safety shaver of claim 1, further comprising:

a second mounting member disposed within said cavity and rigidly attached to said interior surface;

said second mounting member having a second groove machined therethrough;

said first end of said driver member being pivotably attached to said second mounting member;

said second end of said driver member being slidably disposed within said second groove.

3. The safety shaver of claim 2, wherein said electrical energizing means comprises a battery.

4. The safety shaver of claim 2, wherein said electrical energizing means comprises a regenerative drive circuit.

5. The safety shaver of claim 4, wherein said regenerative drive circuit comprises:

a battery having an output side;

a resistor with an input side and an output side;

said input side of said resistor being electrically connected to said output side of said battery;

a CMOS timer chip with an input side and an output side;

said input side of said CMOS timer chip being electrically connected to said output side of said resistor;

an output signal at said output side of said CMOS timer chip being a square wave output;

an inverter array having an input side and first and second output pins;

said input side of said inverter array being electrically connected to said output side of said CMOS timer chip;

said input side of said inverter array being electrically connected to said output side of said resistor;

said first output pin of said inverter array having a first output signal; and said second output pin of said inverter array having a second output signal, said second output signal being an inverse of said first output signal;

a switching array with an input side, first and second input pins and first and second output pins;

said input side of said switching array being electrically connected to said output side of said resistor;

said first input pin of said switching array being electrically connected to said first output pin of said inverter array;

said second input pin of said switching array being electrically connected to said second output pin of said inverter array;

a first pair of MOSFETs electrically connected to said first output pin of said switching array;

said first pair of MOSFETs being electrically connected to an output from said battery;

each of said first pair of MOSFETs having a gate;

a second pair of MOSFETs electrically connected to said second output pin of said switching array;

said second pair of MOSFETs being electrically connected in parallel with said first pair of MOSFETS to said output side of said battery;

each of said second pair of MOSFETs having a gate;

wherein when said gates of said first pair of MOSFETS are de-energized, said gates of said second pair of MOSFETs are energized; and wherein when said gates of said first pair of MOSFETS are energized, said gates of said second pair of MOSFETs are de-energized;

a transformer with an input side and an output side;

said input side of said transformer being electrically connected to said first and second pairs of MOSFETS; and a pair of conductors electrically connected to said electroactive driver member;

said pair of conductors being electrically connected to said output side of said transformer.

6. The safety shaver of claim 5, wherein said electroactive driver member comprises a piezoelectric driver.

7. The safety shaver of claim 6, wherein said piezoelectric driver is prestressed.

8. A safety shaver, comprising:

a housing with an interior cavity having an interior surface;

said interior cavity having first and second recesses in said interior surface, oriented parallel to a longitudinal axis;

a mounting support disposed within said cavity and rigidly attached to said interior surface;

a cutting blade having first and second spaced apart parallel shoulders;

said first and second shoulders being slidably disposed within said first and second recesses respectively;

an electroactive driver member having first and second ends disposed within said cavity;

said first end of said driver member being pivotably attached to said mounting support;

said second end of said driver member being pivotably attached to said cutting blade; and a regenerative drive circuit in electrical communication with said electroactive driver member, said regenerative drive circuit comprising:

a battery having an output side;

a resistor with an input side and an output side;

said input side of said resistor being electrically connected to said output side of said battery;

a CMOS timer chip with an input side and an output side;

said input side of said CMOS timer chip being electrically connected to said output side of said resistor;

an output signal at said output side of said CMOS timer chip being a square wave output;

an inverter array having an input side and first and second output pins;

said input side of said inverter array being electrically connected to said output side of said CMOS timer chip;

said input side of said inverter array being electrically connected to said output side of said resistor;

said first output pin of said inverter array having a first output signal; and said second output pin of said inverter array having a second output signal, said second output signal being an inverse of said first output signal;

a switching array with an input side, first and second input pins and first and second output pins;

said input side of said switching array being electrically connected to said output side of said resistor;

said first input pin of said switching array being electrically connected to said first output pin of said inverter array;

said second input pin of said switching array being electrically connected to said second output pin of said inverter array;

a first pair of MOSFETs electrically connected to said first output pin of said switching array;

said first pair of MOSFETs being electrically connected to said output side of said battery;

each of said first pair of MOSFETs having a gate;

a second pair of MOSFETs electrically connected to said second output pin of said switching array;

said second pair of MOSFETs being electrically connected in parallel with said first pair of MOSFETS to said output side of said battery;

each of said second pair of MOSFETs having a gate;

wherein when said gates of said first pair of MOSFETS are de-energized, said gates of said second pair of MOSFETs are energized; and wherein when said gates of said first pair of MOSFETS are energized, said gates of said second pair of MOSFETs are de-energized;

a transformer with an input side and an output side;

said input side of said transformer being electrically connected to said first and second pairs of MOSFETs; and a pair of conductors electrically connected to said electroactive driver member;

said pair of conductors being electrically connected to said output side of said transformer.

9. The safety shaver of claim 8, wherein said electroactive driver member comprises a piezoelectric driver, said piezoelectric driver comprising:

a piezoelectric element having first and second opposing major faces;

a prestress layer having first and second opposing major faces; and an adhesive layer bonding said first major face of said piezoelectric element to said first major face of said prestress layer.

10. The safety shaver of claim 9, wherein said piezoelectric element is compressively stressed by said adhesive layer and said prestress layer.

* * * * *